US009227710B2

(12) United States Patent
Jung et al.

(10) Patent No.: US 9,227,710 B2
(45) Date of Patent: Jan. 5, 2016

(54) CYLINDRICAL UNDERWATER VEHICLE WITH VERTICAL END PLATE ATTACHED TO PARTIALLY MOVABLE RUDDER

(71) Applicant: AGENCY FOR DEFENSE DEVELOPMENT, Daejeon (KR)

(72) Inventors: Chul-Min Jung, Busan (KR); Chan-Ki Kim, Changwon-si (KR); Kurn-Chul Lee, Gimhae-si (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 262 days.

(21) Appl. No.: 13/986,771

(22) Filed: Jun. 4, 2013

(65) Prior Publication Data

US 2014/0326169 A1 Nov. 6, 2014

(30) Foreign Application Priority Data

May 3, 2013 (KR) ..... 10-2013-0050147

(51) Int. Cl.
*B63H 25/38* (2006.01)
*B63G 8/20* (2006.01)
(Continued)

(52) U.S. Cl.
CPC *B63G 8/20* (2013.01); *B63H 25/38* (2013.01); *F42B 19/01* (2013.01); *F42B 19/06* (2013.01)

(58) Field of Classification Search
CPC .... B63H 25/38; B63H 25/381; B63H 25/382; B63H 25/383; B63H 2025/384; B63H 2025/385; B63H 2025/386; B63H 2025/387; B63H 2025/388; B63G 8/00; B63G 8/14; B63G 8/18; B63G 8/20; B63G 8/26; F41F 3/08; F41F 3/10; F42B 19/01; F42B 19/04; F42B 19/06; F42B 19/08; B64C 23/065
USPC ..... 114/20.1–25, 162–172, 312, 330–332; 244/199.4
See application file for complete search history.

(56) References Cited

U.S. PATENT DOCUMENTS 3,237,580 A * 3/1966 Ilgenfritz et al. ..... 114/23
4,463,700 A * 8/1984 Becker ..... 114/162
(Continued)

FOREIGN PATENT DOCUMENTS

EP 1 349 778 B1 2/2007
EP 1 531 126 B1 2/2007
(Continued)

OTHER PUBLICATIONS

Chulmin Jung et al., "Flow Analysis Around a Partially Movable Control Fin with End Plate," The Korea Institute of Military Science and Technology 2012 Annual Conference, 2012.

*Primary Examiner* — Ajay Vasudeva
(74) *Attorney, Agent, or Firm* — LRK Patent Law Firm

(57) ABSTRACT

A cylindrical underwater vehicle with a vertical end plate attached to a partially movable rudder, including a vertical end plate which is formed in a longitudinal direction of the underwater vehicle and is mounted on a circumference thereof so as to improve a control force with respect to the underwater vehicle. The cylindrical underwater vehicle with a vertical end plate attached to a partially movable rudder, including a fixed plate formed to radially extend, and a movable plate, a front end of which is rotatably mounted to the rear of the fixed plate, includes a first vertical end plate which is formed to have a regular width in a longitudinal direction of the underwater vehicle at an upper end portion of the movable plate and is mounted perpendicular to the movable plate.

9 Claims, 16 Drawing Sheets

(51) Int. Cl.
*F42B 19/01* (2006.01)
*F42B 19/06* (2006.01)

(56) References Cited

U.S. PATENT DOCUMENTS 5,417,176 A * 5/1995 Galib ..... 114/162
6,736,685 B2 * 5/2004 Gieseke ..... 440/67

FOREIGN PATENT DOCUMENTS

JP 01184400 A * 7/1989 ..... F42B 19/01
JP 1989-240398 A 9/1989
JP 1993-039089 A 2/1993
JP 05116687 A * 5/1993 ..... B63H 25/38
KR 10-1142127 B1 5/2012

* cited by examiner

CYLINDRICAL UNDERWATER VEHICLE WITH VERTICAL END PLATE ATTACHED TO PARTIALLY MOVABLE RUDDER

CROSS-REFERENCE TO RELATED APPLICATIONS

This application claims priority to Korean Patent Application No. 10-2013-0050147, filed on May 3, 2013, which is incorporated herein by reference in its entirety.

BACKGROUND OF THE INVENTION

1. Field of the Invention

Exemplary embodiments of the present invention relate to a cylindrical underwater vehicle with a propulsion control blade mounted to the rear thereof for controlling propulsion of the underwater vehicle; and, particularly, to a cylindrical underwater vehicle with a vertical end plate attached to a partially movable rudder, including a vertical end plate which is formed to have a regular width in a longitudinal direction of the underwater vehicle and is mounted on a circumference thereof in order to improve a control force for the underwater vehicle.

2. Description of Related Art

A cylindrical underwater vehicle, such as a torpedo moving under water, includes, at the rear thereof, a propeller to generate a propulsive force, a duct to protect the propeller, propulsion control blades to control a propulsion direction of the cylindrical underwater vehicle under water, etc.

For example, a propulsion control blade as shown in FIG. 1 is mounted to the rear of an underwater vehicle. The propulsion control blade includes a fixed plate 121 which is formed at intervals in a radial direction of the underwater vehicle, and a movable plate 122 which is rotatably mounted to a portion of the rear of the fixed plate 121. The fixed plate 121 is formed in plural numbers along a circumference of the underwater vehicle, and the movable plate 122 is rotatably mounted, at a front end thereof, to the rear of each fixed plate 121 (hereinafter, the propulsion control blade being referred to as "a partially movable rudder" since only the movable plate rotates).

Such a partially movable rudder allows overall movement of the underwater vehicle to be controlled by the fixed plate 121 and additionally rotates the movable plate 122 by a desired angle, so that the propulsion of the underwater vehicle may be accurately controlled.

However, the partially movable rudder of the cylindrical underwater vehicle according to the prior art cannot help having a limited shape.

Since the cylindrical underwater vehicle such as a torpedo has a maximum diameter equal to or less than an inner diameter of a launch tube, the partially movable rudder, namely, the fixed plate 121 and the movable plate 122 cannot help being limited in size and shape.

According to the propulsion control blade of the prior art, due to the above-mentioned limit of the shape, a vortex is generated at an edge portion of the propulsion control blade while fluid moves from a high-pressure portion to a low-pressure portion by a pressure difference between opposite surfaces of the propulsion control blade.

For example, FIG. 2 shows distribution of a vorticity field by the movable plate 122 in the propulsion control blade of the cylindrical underwater vehicle as described above. As shown in FIG. 2, the vorticity field is distributed at a position of n times in a longitudinal direction of the movable plate.

Here, it may be seen that a large vorticity field by the movable plate 122 is generated at a portion indicated by a red color and deep color.

Since such a vortex causes a reduction in lift and an increase in resistance, the propulsive force of the underwater vehicle may be decreased and further the underwater vehicle may not be accurately controlled.

SUMMARY OF THE INVENTION

An embodiment of the present invention is directed to a cylindrical underwater vehicle with a vertical end plate attached to a partially movable rudder, including a vertical end plate which is formed in a radial direction of the underwater vehicle so as to improve a control force and decrease a drive moment by reducing a vortex at an upper end portion of a movable plate or a fixed plate in a propulsion control blade of the cylindrical underwater vehicle.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a cylindrical underwater vehicle with a vertical end plate attached to a partially movable rudder, including a fixed plate formed to radially extend, and a movable plate, a front end of which is rotatably mounted to the rear of the fixed plate, includes a first vertical end plate which is formed to have a regular width in a longitudinal direction of the underwater vehicle at an upper end portion of the movable plate and is mounted perpendicular to the movable plate.

The first vertical end plate may have an arc-shaped upper side in section.

The first vertical end plate may have the upper side in section, formed to have the same curvature as an inner surface of a launch tube into which the underwater vehicle is loaded and launched.

The fixed plate and the movable plate may be provided in plural numbers to be arranged along a circumference of the underwater vehicle at equal intervals by a given angle, and the first vertical end plate may be formed for each of the plural movable plates.

The cylindrical underwater vehicle may further include a second vertical end plate which is formed to have a regular width in a longitudinal direction of the underwater vehicle at an upper end portion of the fixed plate, is mounted perpendicular to the fixed plate, and is formed in a circumferential direction of the underwater vehicle.

The second vertical end plate may have an arc-shaped upper side in section.

The second vertical end plate may have the upper side in section, formed to have the same curvature as an inner surface of a launch tube into which the underwater vehicle is loaded and launched.

The fixed plate may be provided in plural numbers to be arranged along a circumference of the underwater vehicle at equal intervals by a given angle, and the second vertical end plate may be formed for each of the plural fixed plates.

A front end of the first vertical end plate may have an arc shape, and a rear end of the second vertical end plate may be formed to come into linear contact with the front end of the first vertical end plate.

The rear end of the second vertical end plate may be formed to have the same curvature as the front end of the first vertical end plate.

DESCRIPTION OF SPECIFIC EMBODIMENTS

Figure 1:
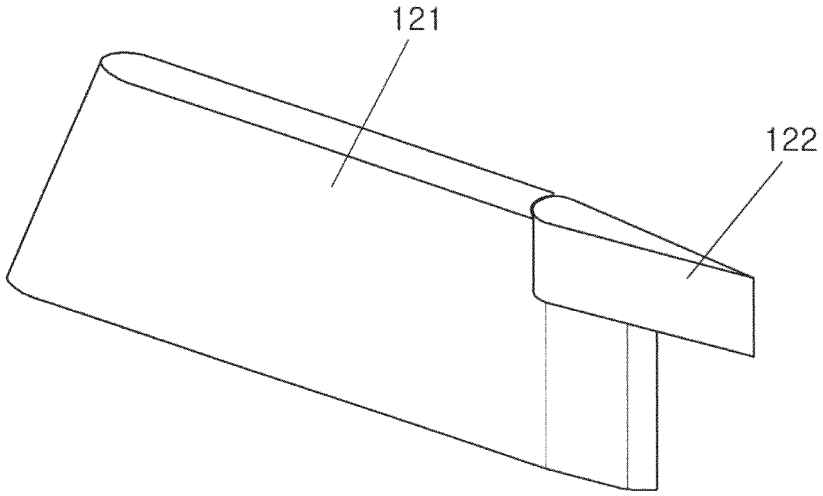
FIG.1 (Prior Art)
FIG. 1 is a perspective view illustrating a propulsion control blade of a cylindrical underwater vehicle according to the prior art.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Hereinafter, a cylindrical underwater vehicle with a vertical end plate attached to a partially movable rudder according to embodiments of the present invention will be described with reference to the accompanying drawings.

The cylindrical underwater vehicle 10 with a vertical end plate attached to a partially movable rudder according to embodiments of the present invention includes vertical end plates 23*a* and 23*b* which are formed to have a regular width in a longitudinal direction of the underwater vehicle 10 at respective upper end portions of a movable plate 22 and a fixed plate 21 and are mounted on a circumference thereof so as to be perpendicular to the movable plate 22 and the fixed plate 21.

A first vertical end plate 23*a* is mounted at the upper end portion of the movable plate 22 so as to be perpendicular to the movable plate 22 in a longitudinal direction thereof.

The first vertical end plate 23*a* is mounted at the upper end portion of the movable plate 22, namely, at a position farthest away from an axial center of the underwater vehicle 10.

In addition, the first vertical end plate 23*a* is formed in the longitudinal direction of the movable plate 22. Here, the first vertical end plate 23*a* may be formed along a portion of a length of the movable plate 22, and preferably be formed all over the length of the movable plate 22.

In this case, the first vertical end plate 23*a* is mounted perpendicular to the movable plate 22. Since the first vertical end plate 23*a* and the movable plate 22 are mounted perpendicular to each other, the first vertical end plate 23*a* is formed to have a regular width in the longitudinal direction of the underwater vehicle 10.

Accordingly, the first vertical end plate 23*a* has a "T" shape when viewed from the rear in a state of being mounted to the movable plate 22.

Figure 7:
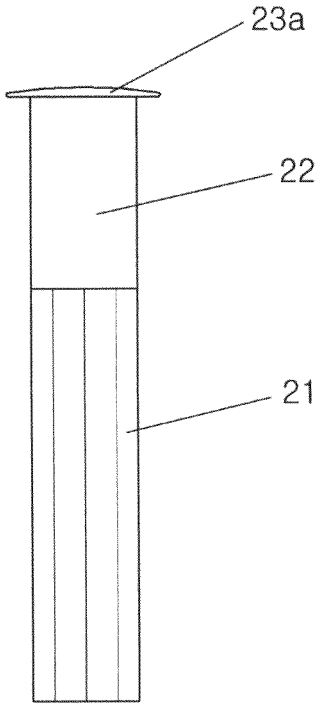
FIG. 7 is a side view illustrating the rear of the cylindrical underwater vehicle with a vertical end plate attached to a partially movable rudder according to the first embodiment of the present invention.
Figure 8:
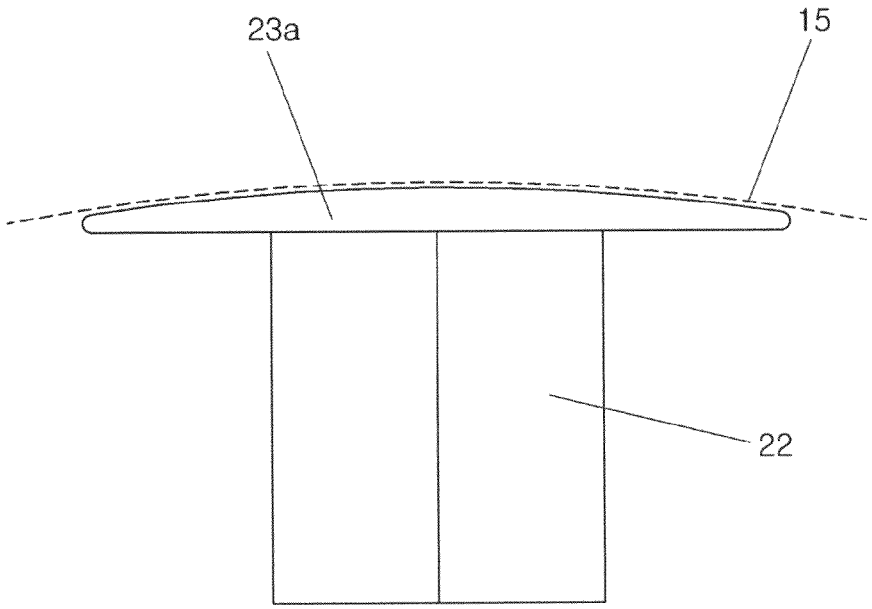
FIG. 8 is an enlarged view of FIG. 7.

Particularly, since the underwater vehicle 10 is loaded into a launch tube 15 and an upper surface of the first vertical end plate 23*a* is tightly closed to an inner surface of the launch tube 15, an upper side of the first vertical end plate 23*a* which comes into contact with the inner surface of the launch tube 15 has an arc shape in section (see FIGS. 7 and 8).

More preferably, the upper surface of the first vertical end plate 23*a* is formed to have curvature equal to the inner surface of the launch tube 15.

The fixed plate 21 is mounted in plural numbers along the circumference of the underwater vehicle 10 at equal intervals by a given angle, and the movable plate 22 is mounted for each fixed plate 21. Consequently, the first vertical end plate 23*a* is also provided in plural numbers to be arranged along the circumference of the underwater vehicle 10 at equal intervals by a given angle.

A second vertical end plate 23*b* is formed at the upper end portion of the fixed plate 21 so as to have a regular width in a longitudinal direction of the fixed plate 21, and is mounted perpendicular to the fixed plate 21.

The second vertical end plate 23*b* is also formed at the outermost upper end portion of the fixed plate 21 so as to be tightly closed to the inner surface of the launch tube 15.

Figure 13:
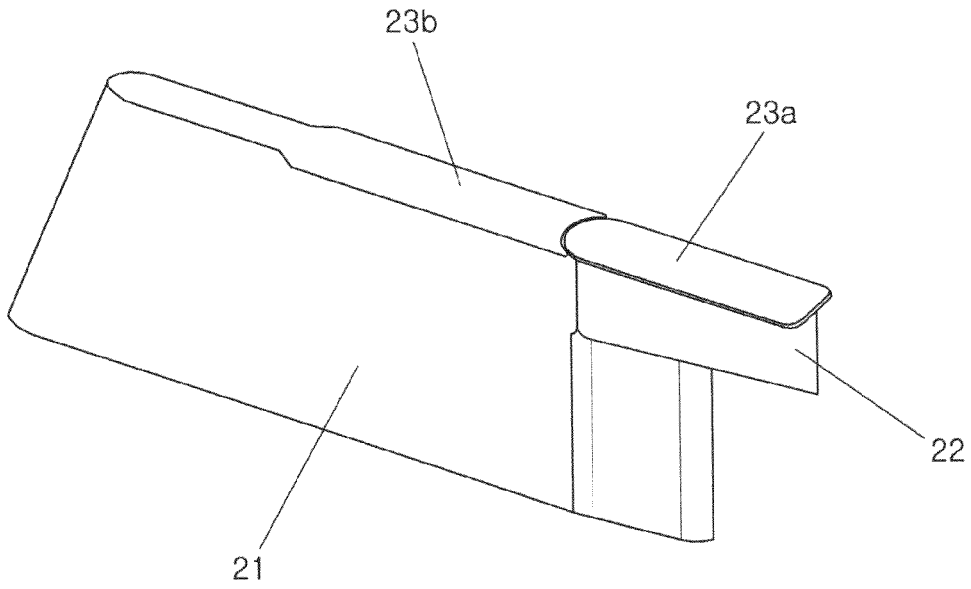
FIG. 13 is a perspective view illustrating a cylindrical underwater vehicle with a vertical end plate attached to a partially movable rudder according to a second embodiment of the present invention.
Figure 14:
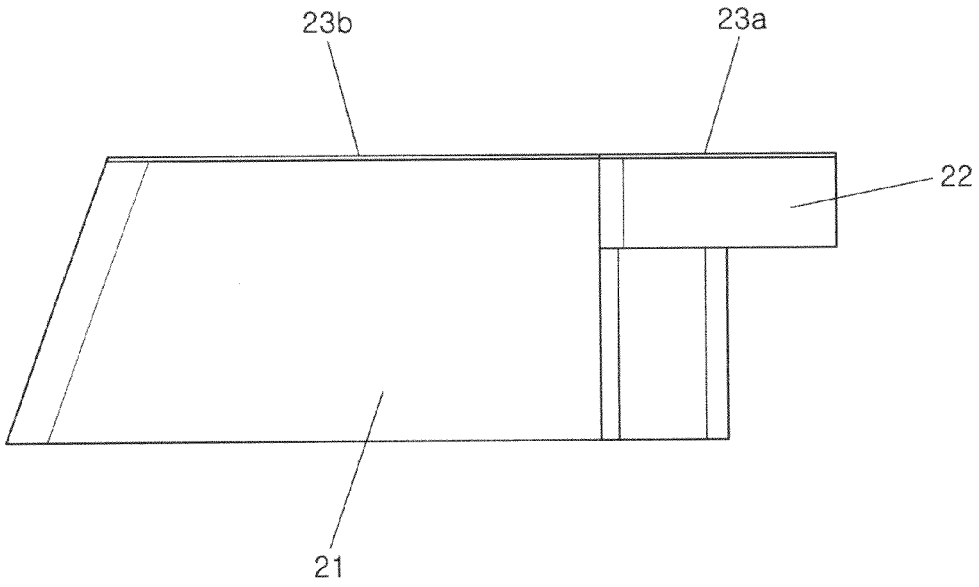
FIG. 14 is a front view illustrating the cylindrical underwater vehicle with a vertical end plate attached to a partially movable rudder according to the second embodiment of the present invention.
Figure 15:
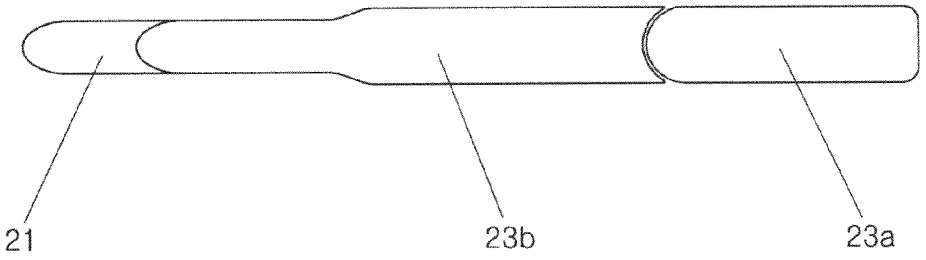
FIG. 15 is a top view illustrating the cylindrical underwater vehicle with a vertical end plate attached to a partially movable rudder according to the second embodiment of the present invention.
Figure 16:
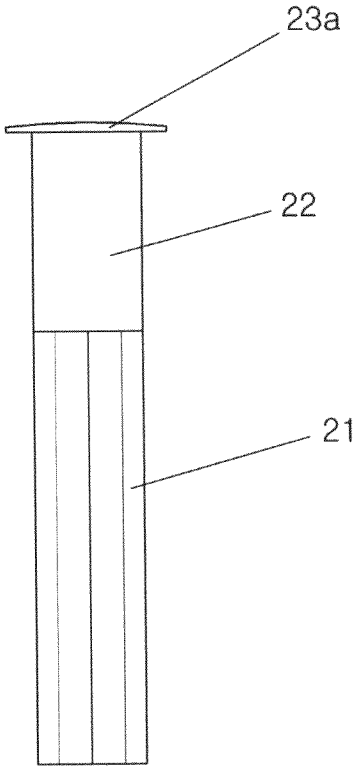
FIG. 16 is a side view illustrating the cylindrical underwater vehicle with a vertical end plate attached to a partially movable rudder according to the second embodiment of the present invention.

The second vertical end plate 23*b* may be formed along a portion of a length of the fixed plate 21, as shown in FIG. 13, or may be formed all over the length of the fixed plate 21 although not shown.

In addition, since the second vertical end plate 23*b* is formed perpendicular to the fixed plate 21, a connection portion of the fixed plate 21 and the second vertical end plate 23*b* has a "T" shape in section.

Moreover, an upper side of the second vertical end plate 23*b* which comes into contact with the inner surface of the launch tube 15 has an arc shape in section. Preferably, the arc shape is formed to be equal to the curvature of the inner surface of the launch tube 15, and thus the upper surface of the second vertical end plate 23*b* is tightly closed to the inner surface of the launch tube 15. Here, the second vertical end plate 23*b* preferably has the same cross section as the first vertical end plate 23*a*, and particularly the upper sides of the first and second vertical end plates 23*a* and 23*b* are preferably formed to be equal to each other in section.

The second vertical end plate 23*b* is preferably formed for each fixed plate 21 which is provided in plural numbers along the circumference of the underwater vehicle 10.

Such a second vertical end plate 23*b* preferably has the same sectional structure as the first vertical end plate 23*a*.

In addition, a rear end of the second vertical end plate 23*b* is formed to come into contact with the first vertical end plate 23*a*.

In this case, since the movable plate 22 formed with the first vertical end plate 23*a* is rotatably mounted relative to the fixed plate 21 formed with the second vertical end plate 23*b*, a front end of the first vertical end plate 23*a* has an arc shape and the rear end of the second vertical end plate 23*b* is formed to be spaced apart from front end of the first vertical end plate 23*a* by a predetermined distance. Particularly, the rear end of the second vertical end plate 23*b* is preferably formed to have the same curvature as the front end of the first vertical end plate 23*a*.

The following description will be given of an operation of the cylindrical underwater vehicle with a vertical end plate attached to a partially movable rudder according to embodiments of the present invention having the above configuration.

The first vertical end plate 23*a* is formed at the upper end portion of the movable plate 22. Thus, a vortex generated due to a pressure difference at the end portion of the movable plate 22 is reduced, thereby improving a control force of a propulsion control blade, namely, of a partially movable rudder.

To this end, when modeling the movable plate 22 and the first vertical end plate 23*a* in the partially movable rudder to view the distribution of a vorticity field depending on whether the first vertical end plate 23*a* exists or not, it may be seen that the vortex generated at the end portion of the movable plate 22 is reduced by the first vertical end plate 23*a*.

Figure 9:
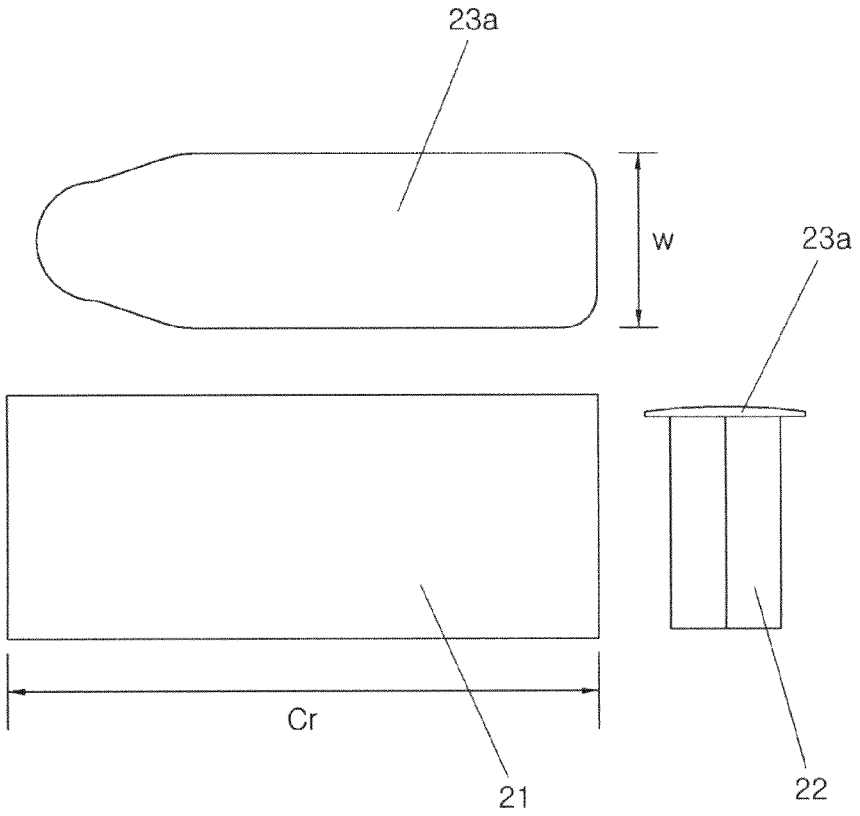
FIG. 9 is a view illustrating a modeled shape in order to measure distribution of a vorticity field in the cylindrical underwater vehicle with a vertical end plate attached to a partially movable rudder according to the first embodiment of the present invention.
Figure 10:
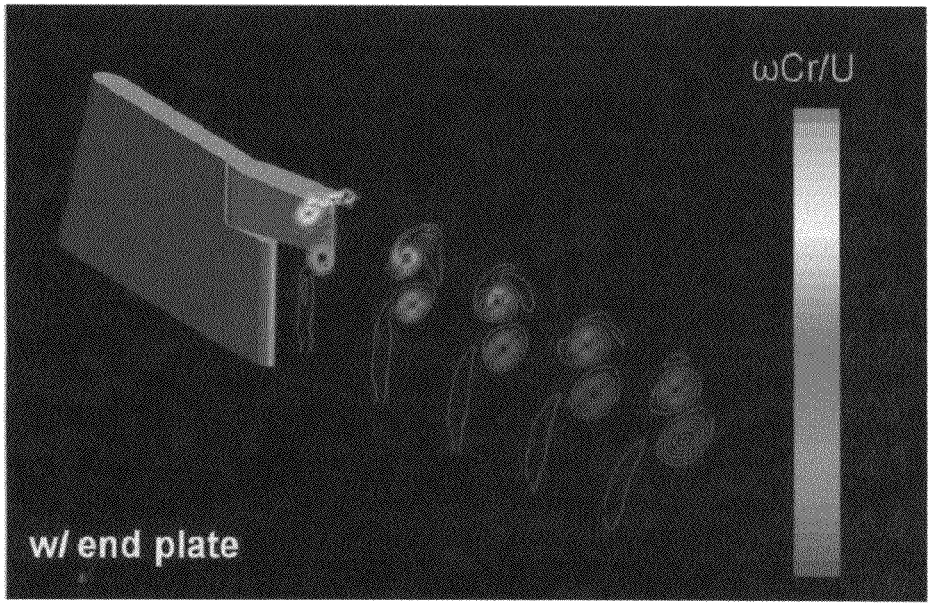
FIG. 10 is a graph illustrating the distribution of the vorticity field by the cylindrical underwater vehicle with a vertical end plate attached to a partially movable rudder according to the first embodiment of the present invention.

That is, FIG. 10 illustrates a result in which the movable plate 22 and the first vertical end plate 23*a* are molded as shown in FIG. 9 and the distribution of the nondimensionalized vorticity field $\omega Cr/U$ is measured.

Figure 2:
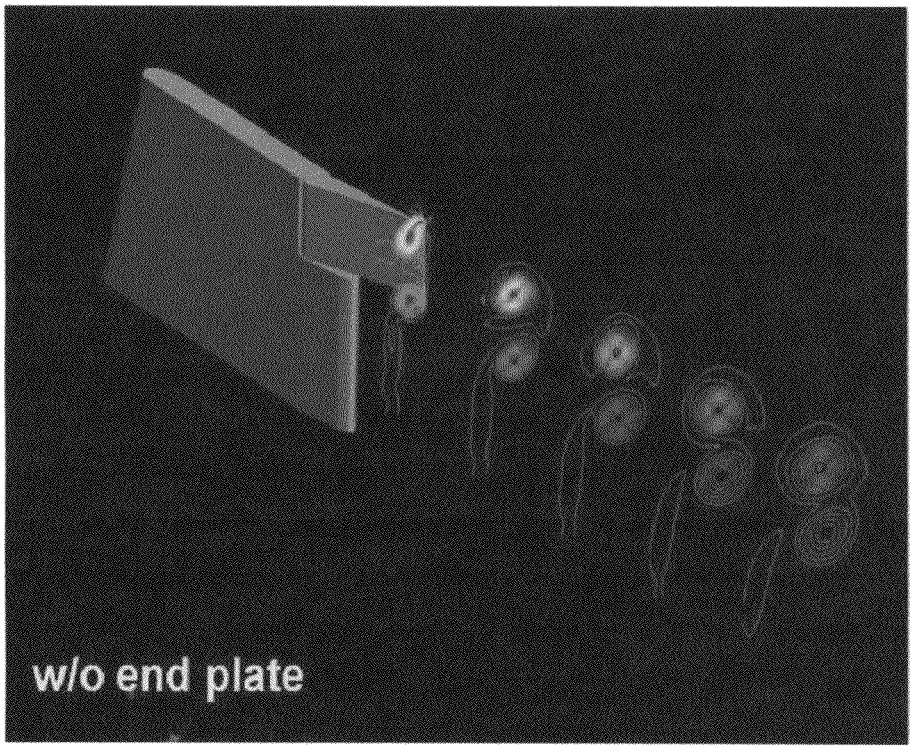
FIG.2(Prior Art)
FIG. 2 is a graph illustrating distribution of a vorticity field by the propulsion control blade of the cylindrical underwater vehicle according to the prior art.
Figure 3:
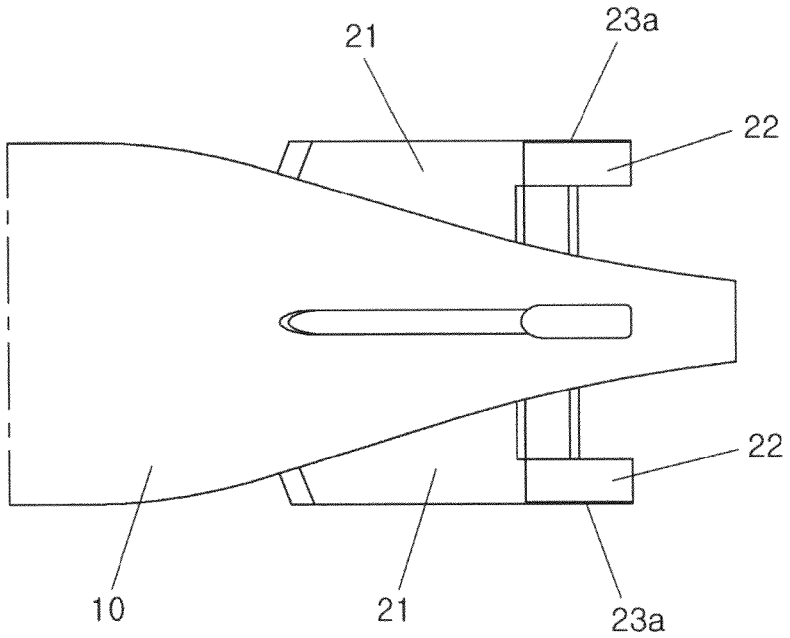
FIG. 3 is a front view illustrating the rear of a cylindrical underwater vehicle with a vertical end plate attached to a partially movable rudder according to a first embodiment of the present invention.
Figure 4:
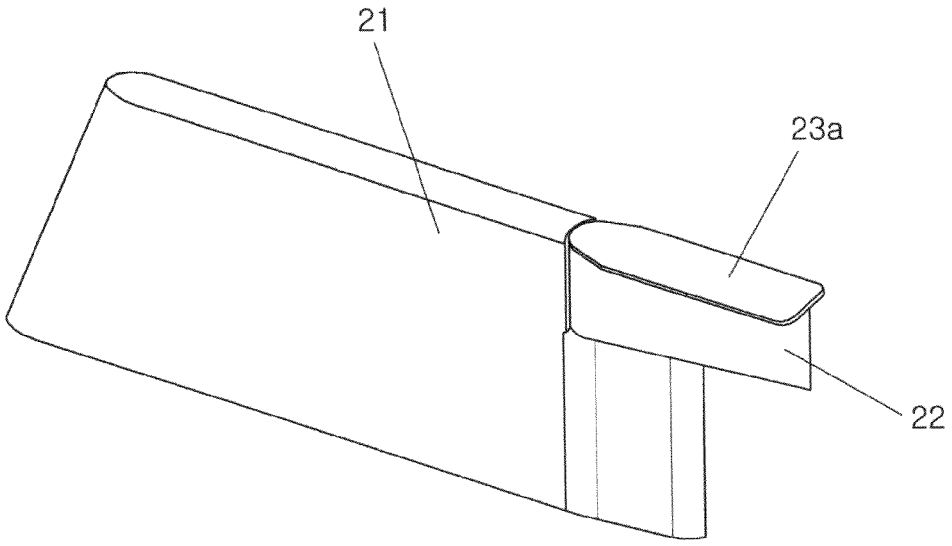
FIG. 4 is a perspective view illustrating the cylindrical underwater vehicle with a vertical end plate attached to a partially movable rudder according to the first embodiment of the present invention.
Figure 5:
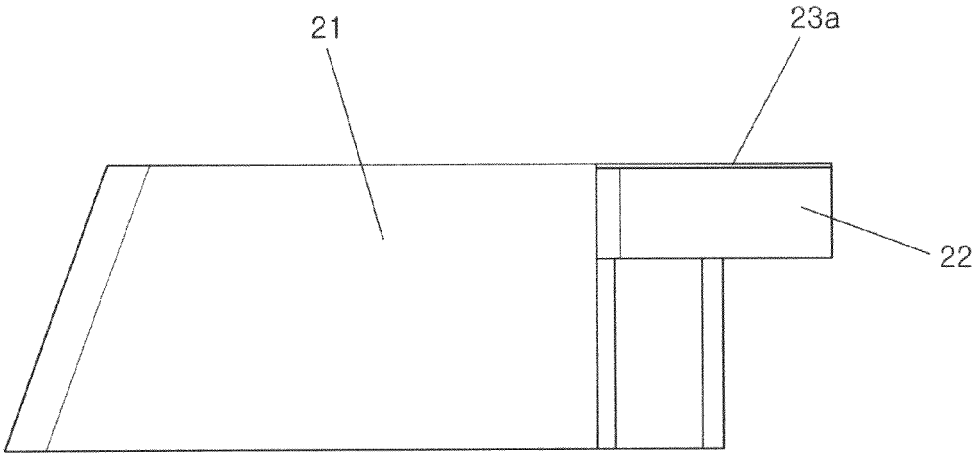
FIG. 5 is a front view illustrating the cylindrical underwater vehicle with a vertical end plate attached to a partially movable rudder according to the first embodiment of the present invention.
Figure 6:
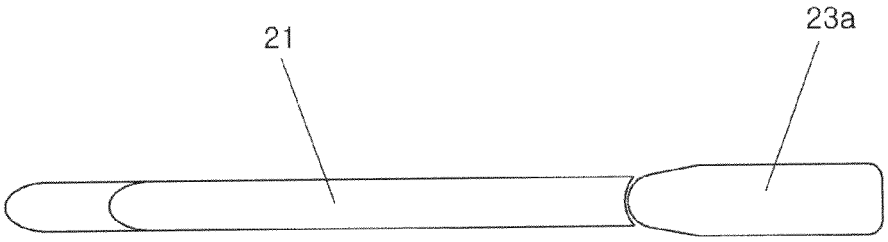
FIG. 6 is a top view illustrating the cylindrical underwater vehicle with a vertical end plate attached to a partially movable rudder according to the first embodiment of the present invention.

When comparing the above result to FIG. 2 showing the distribution of the nondimensionalized vorticity field in a state in which the first vertical end plate 23*a* is not provided, it may be seen that the vortex is gradually reduced by a decrease in area of a region and deep color in a portion indicated by a red color in cross-section at positions of 1, 2, 3, 4, and 5 times with respect to the length Cr of the movable plate 22.

Figure 11:
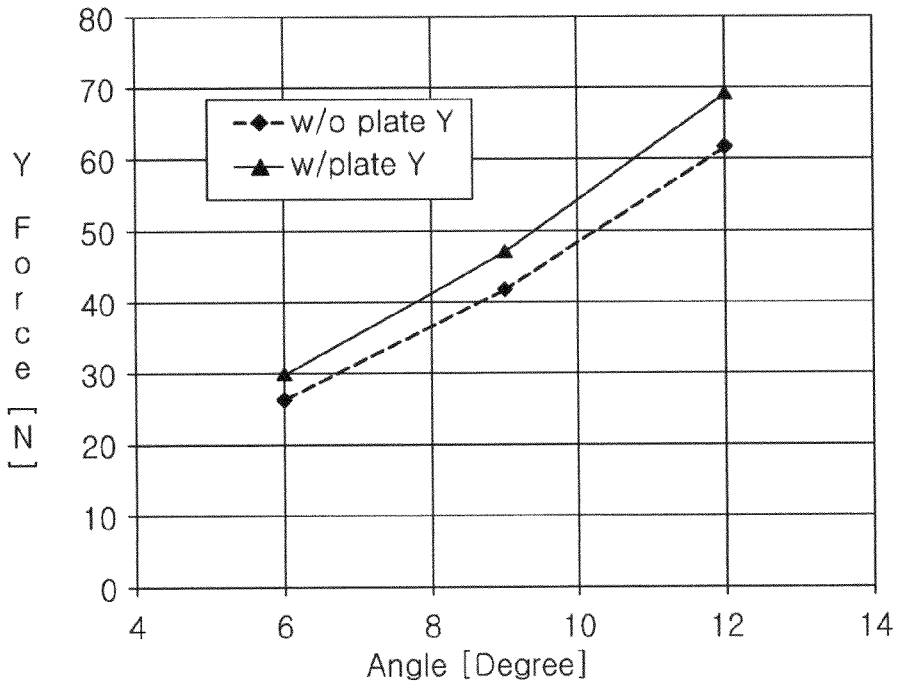
FIG. 11 is a graph illustrating a force in the Y-axis direction by rotation of a movable plate in the cylindrical underwater vehicle with a vertical end plate attached to a partially movable rudder according to the first embodiment of the present invention.

Meanwhile, FIG. 11 illustrates a force acting on the movable plate 22 in the Y direction (direction perpendicular to the surface of the movable plate) depending on whether the first vertical end plate 23*a* exists or not and the rotation angle of the movable plate 22.

Since the movable plate 22 is rotatably mounted to the fixed plate 21, the force acting depending on the rotation angle in the Y direction is varied. This is shown in FIG. 11. Here, it may be seen that a substantial force in the Y direction is generated when the first vertical end plate 23*a* is attached and a larger control force may be obtained.

Figure 12:
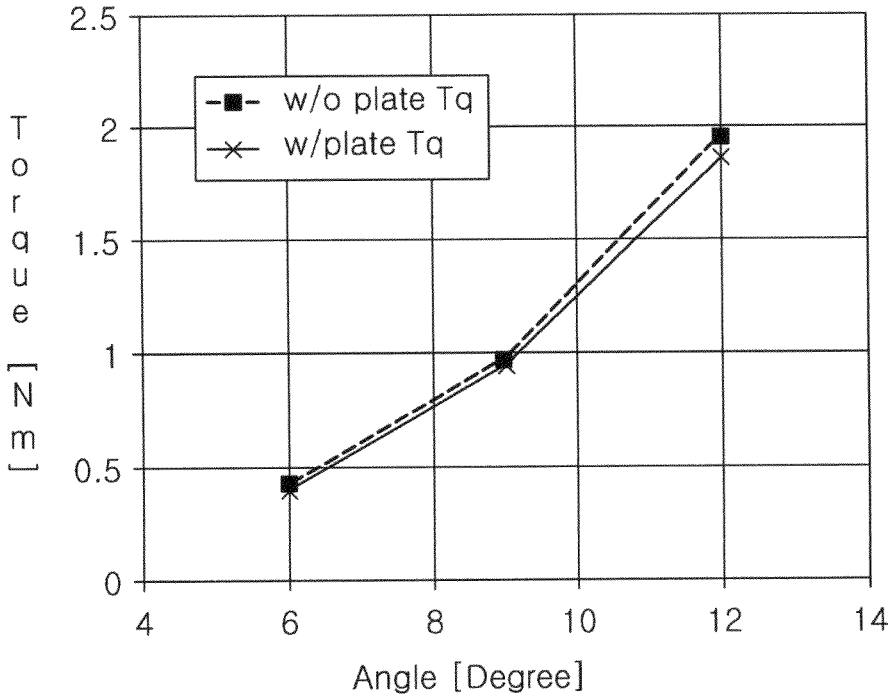
FIG. 12 is a graph illustrating torque required for the rotation of the movable plate in the cylindrical underwater vehicle with a vertical end plate attached to a partially movable rudder according to the first embodiment of the present invention.

Moreover, FIG. 12 illustrates torque required for a drive shaft so as to be adjusted to the rotation angle of the movable plate 22. As shown in FIG. 12, when the movable plate 22 rotates at an angle of 6 degrees, an angle of 9 degrees, and an angle of 12 degrees, the required torque is almost the same regardless of the existence of the first vertical end plate 23*a*. This is because there is no difference of a whole change in torque due to shortness of a moment arm along with forward movement of a pressure center although the control force is increased by the attachment of the first vertical end plate 23*a*.

Accordingly, when synthetically viewing FIGS. 11 and 12, it may be seen that even when the first vertical end plate 23*a* is mounted, the control force is significantly improved although the torque required to drive the movable plate 22 is slightly increased.

In accordance with a cylindrical underwater vehicle with a vertical end plate attached to a partially movable rudder according to the exemplary embodiments of the present invention, it may be possible to reduce a vortex generated at an end portion of a fixed plate or a movable plate by a vertical end plate mounted on a circumference of the underwater vehicle at the end portion of the fixed plate or the movable plate.

Since the vortex is reduced at the end portion of the fixed plate or the movable plate, it may be possible to decrease a reduction in lift and an increase in resistance due to the vortex. As a result, it may be possible to enhance a control force of a propulsion control blade with respect to the underwater vehicle.

In addition, since the control force of the propulsion control blade with respect to the underwater vehicle is enhanced, it may be possible to decrease a drive force required to drive the movable plate in the propulsion control blade in order to generate the same control force.

Furthermore, since a less drive force is required to exhibit the same control force, design degrees of freedom for a space of the rear of the cylindrical underwater vehicle may be improved and the size of components required for drive may be minimized. Therefore, additional devices such as a proximity magnetic sensor may be installed in such an additionally obtained space.

While the present invention has been described with respect to the specific embodiments, it will be apparent to those skilled in the art that various changes and modifications may be made without departing from the spirit and scope of the invention as defined in the following claims.

What is claimed is:

1. A cylindrical underwater vehicle with at least one vertical end plate attached to a partially movable rudder, including a fixed plate formed to radially extend, and a movable plate, a front end of which is rotatably mounted to the rear of the fixed plate, the at least one vertical end plate further comprising:

a first vertical end plate which is formed to have a uniform width in a longitudinal direction of the underwater vehicle at an upper end portion of the movable plate and is mounted perpendicular to the movable plate, wherein the first vertical end plate has an arc-shaped upper side in section.

2. The cylindrical underwater vehicle according to claim 1, wherein the first vertical end plate has the upper side in section, formed to have the same curvature as an inner surface of a launch tube into which the underwater vehicle is loaded and launched.

3. The cylindrical underwater vehicle according to claim 1, wherein:

the fixed plate and the movable plate are provided in plural numbers to be arranged along a circumference of the underwater vehicle at equal intervals by a given angle; and the first vertical end plate is formed for each of the plural movable plates.

4. The cylindrical underwater vehicle according to claim 1, further comprising:

a second vertical end plate which is formed to have a regular width in a longitudinal direction of the underwater vehicle at an upper end portion of the fixed plate, is mounted perpendicular to the fixed plate, and is formed in a circumferential direction of the underwater vehicle.

5. The cylindrical underwater vehicle according to claim 4, wherein the second vertical end plate has an arc-shaped upper side in section.

6. The cylindrical underwater vehicle according to claim 5, wherein the second vertical end plate has the upper side in section, formed to have the same curvature as an inner surface of a launch tube into which the underwater vehicle is loaded and launched.

7. The cylindrical underwater vehicle according to claim 4, wherein:

the fixed plate is provided in plural numbers to be arranged along a circumference of the underwater vehicle at equal intervals by a given angle; and the second vertical end plate is formed for each of the plural fixed plates.

8. The cylindrical underwater vehicle according to claim 4, wherein a front end of the first vertical end plate has an arc shape, and a rear end of the second vertical end plate is formed to be spaced apart from front end of the first vertical end plate by a predetermined distance.

9. The cylindrical underwater vehicle according to claim 8, wherein the rear end of the second vertical end plate is formed to have the same curvature as the front end of the first vertical end plate.

* * * * *